US012662914B2

(12) United States Patent
Hamid et al.

(10) Patent No.: US 12,662,914 B2
(45) Date of Patent: Jun. 23, 2026

(54) PERFORATING TOOL WITH A HYDRAULICALLY ACTUATED ASSEMBLY

(71) Applicants: Saudi Arabian Oil Company, Dhahran (SA); Schlumberger Middle East, S.A., Dubai (AE)

(72) Inventors: Osman Hamid, Richmond, TX (US); Hussain Khalifa Al-Dakheel, Dammam (SA); Gallyam Aidagulov, Dhahran (SA); Murtadha J. AlTammar, Dhahran (SA); Khalid Mohammed M. Alruwaili, Dammam (SA)

(73) Assignees: Saudi Arabian Oil Company, Dhahran (SA); Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/642,230

(22) Filed: Apr. 22, 2024

(65) Prior Publication Data

US 2025/0327383 A1 Oct. 23, 2025

(51) Int. Cl.
*E21B 43/114* (2006.01)
*E21B 23/04* (2006.01)

(52) U.S. Cl.
CPC ..... *E21B 43/114* (2013.01); *E21B 23/0422* (2020.05)

(58) Field of Classification Search
CPC ..... E21B 43/114; E21B 23/0422
See application file for complete search history.

(56) References Cited

U.S. PATENT DOCUMENTS

| | | | | |
|---|---|---|---|---|
| 2,203,796 | A | 6/1940 | O'neill | |
| 5,445,220 | A * | 8/1995 | Gurevich | E21B 23/0413 166/55 |
| 10,502,035 | B2 * | 12/2019 | Sandkleiva | E21B 43/112 |
| 10,605,061 | B2 | 3/2020 | Andreychuk et al. | |
| 11,619,127 | B1 | 4/2023 | AlTammar et al. | |
| 11,649,702 | B2 | 5/2023 | Alruwaili et al. | |
| 2012/0298781 | A1 | 11/2012 | Xu | |

(Continued)

FOREIGN PATENT DOCUMENTS

CN 105736006 11/2018

OTHER PUBLICATIONS

Huang et al., "Application of Abrasive Water Jet Perforation Assisting Fracturing," Petroleum Science and Technology, Mar. 31, 2008, 26(6):717-725, 9 pages.

(Continued)

*Primary Examiner* — Tara Schimpf
*Assistant Examiner* — Daniel T Craig
(74) *Attorney, Agent, or Firm* — Fish & Richardson P.C.

(57) ABSTRACT

Devices, systems, and methods for a bottom hole assembly to form perforations are provided. An abrasive jet perforating tool is configured to couple to a downhole conveyance that is extendable from a terranean surface, through a wellbore, and to a subterranean formation. The abrasive jet perforating tool is configured to inject abrasive particles along a radial direction to create perforations in the subterranean formation. A hydraulically actuated subassembly is attached to the abrasive jet perforating tool and configured to move the abrasive jet perforating tool towards or away from the subterranean formation along the radial direction.

19 Claims, 6 Drawing Sheets

(56) References Cited

U.S. PATENT DOCUMENTS

| | | | | |
|---|---|---|---|---|
| 2017/0234115 | A1* | 8/2017 | Sandkleiva | E21B 23/01 166/55.1 |
| 2022/0178208 | A1 | 6/2022 | Aidagulov et al. | |
| 2025/0327382 | A1 | 10/2025 | AlTammar et al. | |
| 2025/0327384 | A1 | 10/2025 | AlTammar et al. | |

OTHER PUBLICATIONS

Melentiev et al., "Theoretical study on particle velocity in micro-abrasive jet machining," Powder Technology, Feb. 15, 2019, 344:121-132, 12 pages.

Zwaneburg et al., "Well Abandonment: Abrasive Jetting to Access a Poorly Cemented Annulus and Placing a Sealant," Presented at the SPE Annual Technical Conference and Exhibition, San Antonio, Texas, USA, Oct. 2012, 11 pages.

International Search Report and Written Opinion in International Appln. No. PCT/US2025/024862, mailed on Jun. 26, 2025, 15 pages.

* cited by examiner

PERFORATING TOOL WITH A HYDRAULICALLY ACTUATED ASSEMBLY

TECHNICAL FIELD

The present disclosure relates to forming perforations in oil and gas wells, and in geothermal and $CO_2$ injection (CCS) wells.

BACKGROUND

In the oil and gas industry, perforation jobs are performed across the pay zone to create a flow path from the formation into the wellbore. Perforation jobs can be performed using downhole perforating tools that include a perforation gun, an abrasive jet perforating tool, or similar type of tool. A perforating gun generally holds several explosive-shaped charges. The shaped charges can be configured to focus the explosive energy in a specific direction and create perforations through the casing and cement, penetrating into the surrounding formation. An abrasive jet perforating tool deploys high-pressure abrasive fluid jets to cut through the casing, cement and into the surrounding formations. In some cases, one-third of perforation clusters do not yield oil or gas. Knowing where to appropriately place perforations, determining the hydraulic fracturing stages and achieving desired perforation geometry still remains a challenge for the oil and gas industry.

SUMMARY

The present disclosure describes methods, devices, systems and techniques for a perforating tool with a hydraulically actuated assembly for adjusting standoff distances.

In an example implementation, a bottom hole assembly configured to form perforations includes an abrasive jet perforating tool configured to couple to a downhole conveyance that is extendable from a terranean surface, through a wellbore, and to a subterranean formation. The abrasive jet perforating tool is configured to inject abrasive particles along a radial direction to create perforations in the subterranean formation. The bottom hole assembly includes a hydraulically actuated subassembly attached to the abrasive jet perforating tool and configured to move the abrasive jet perforating tool towards or away from the subterranean formation along the radial direction.

In an aspect combinable with the example implementation, the hydraulically actuated subassembly includes one or more telescopic cylinders that each has a plurality of stages configured to sequentially extend or retract along the radial direction.

In another aspect combinable with one, some, or all of the previous aspects, the hydraulically actuated subassembly is configured to move the abrasive jet perforating tool towards the subterranean formation in response to a first fluid pressure and retract the abrasive jet perforating tool away from the subterranean formation in response to a second fluid pressure.

In another aspect combinable with one, some, or all of the previous aspects, the first fluid pressure is higher than the second fluid pressure.

In another aspect combinable with one, some, or all of the previous aspects, the hydraulically actuated subassembly includes a telescopic jet nozzle configured to move radially towards or away from the subterranean formation.

In another aspect combinable with one, some, or all of the previous aspects, a movement of the telescopic jet nozzle is configured to be hydraulically controlled by a fluid pressure.

In another example implementation, a bottom hole assembly configured to form perforations includes a top subassembly configured to couple to a downhole conveyance that is extendable from a terranean surface, through a wellbore, and to a subterranean formation; an abrasive jet perforating tool configured to couple to the downhole conveyance and inject abrasive particles along a radial direction to create perforations in the subterranean formation; and a hydraulically actuated subassembly attached to the abrasive jet perforating tool. The hydraulically actuated subassembly is configured to direct the abrasive particles out of the abrasive jet perforating tool and move towards or away from the subterranean formation along the radial direction.

In an aspect combinable with the example implementation, a movement of the hydraulically actuated subassembly is configured to be hydraulically controlled by fluid pressure.

In another aspect combinable with one, some, or all of the previous aspects, the hydraulically actuated subassembly includes a telescopic jet nozzle configured to move towards the subterranean formation in response to a first fluid pressure and retract away from the subterranean formation in response to a second fluid pressure.

In another aspect combinable with one, some, or all of the previous aspects, the first fluid pressure is higher than the second fluid pressure.

In another aspect combinable with one, some, or all of the previous aspects, the telescopic jet nozzle is configured to extend into one of the perforations in response to the first fluid pressure.

In another aspect combinable with one, some, or all of the previous aspects, the telescopic jet nozzle includes a plurality of stages configured to sequentially extend or retract along the radial direction.

In another example implementation, a method to form perforations includes positioning a bottom hole assembly into a wellbore formed from a terranean surface into a subterranean formation. The bottom hole assembly includes an abrasive jet perforating tool and a hydraulically actuated subassembly attached to the abrasive jet perforating tool. The method includes operating, at a first standoff distance, the abrasive jet perforating to perform a first blasting to create initial holes; in response to a first fluid pressure, operating the hydraulically actuated subassembly to move the abrasive jet perforating tool towards the initial holes; at a second standoff distance, operating the abrasive jet perforating tool to perform a second blasting towards the initial holes to create perforations in the subterranean formation; and in response to a second fluid pressure, operating the hydraulically actuated subassembly to retract the abrasive jet perforating tool away from the perforations.

In an aspect combinable with the example implementation, the hydraulically actuated subassembly includes one or more telescopic cylinders each having a plurality of stages configured to sequentially extend or retract along a radial direction.

In another aspect combinable with one, some, or all of the previous aspects, the hydraulically actuated subassembly includes a telescopic jet nozzle configured to direct abrasive particles out of the abrasive jet perforating tool and move towards or away from the subterranean formation along a radial direction.

In another aspect combinable with one, some, or all of the previous aspects, the telescopic jet nozzle includes a plurality of stages configured to sequentially extend or retract along the radial direction.

In another aspect combinable with one, some, or all of the previous aspects, the telescopic jet nozzle is extended into one of the initial holes in the subterranean formation.

In another aspect combinable with one, some, or all of the previous aspects, the first fluid pressure is higher than the second fluid pressure.

In another aspect combinable with one, some, or all of the previous aspects, the perforations are deeper and wider than the initial holes.

In another aspect combinable with one, some, or all of the previous aspects, the second standoff distance is shorter than the first standoff distance.

The details of one or more implementations of the subject matter described in this specification are set forth in the accompanying drawings and the description below. Other features, aspects, and advantages of the subject matter will become apparent from the description, the drawings, and the claims.

Figure 1:
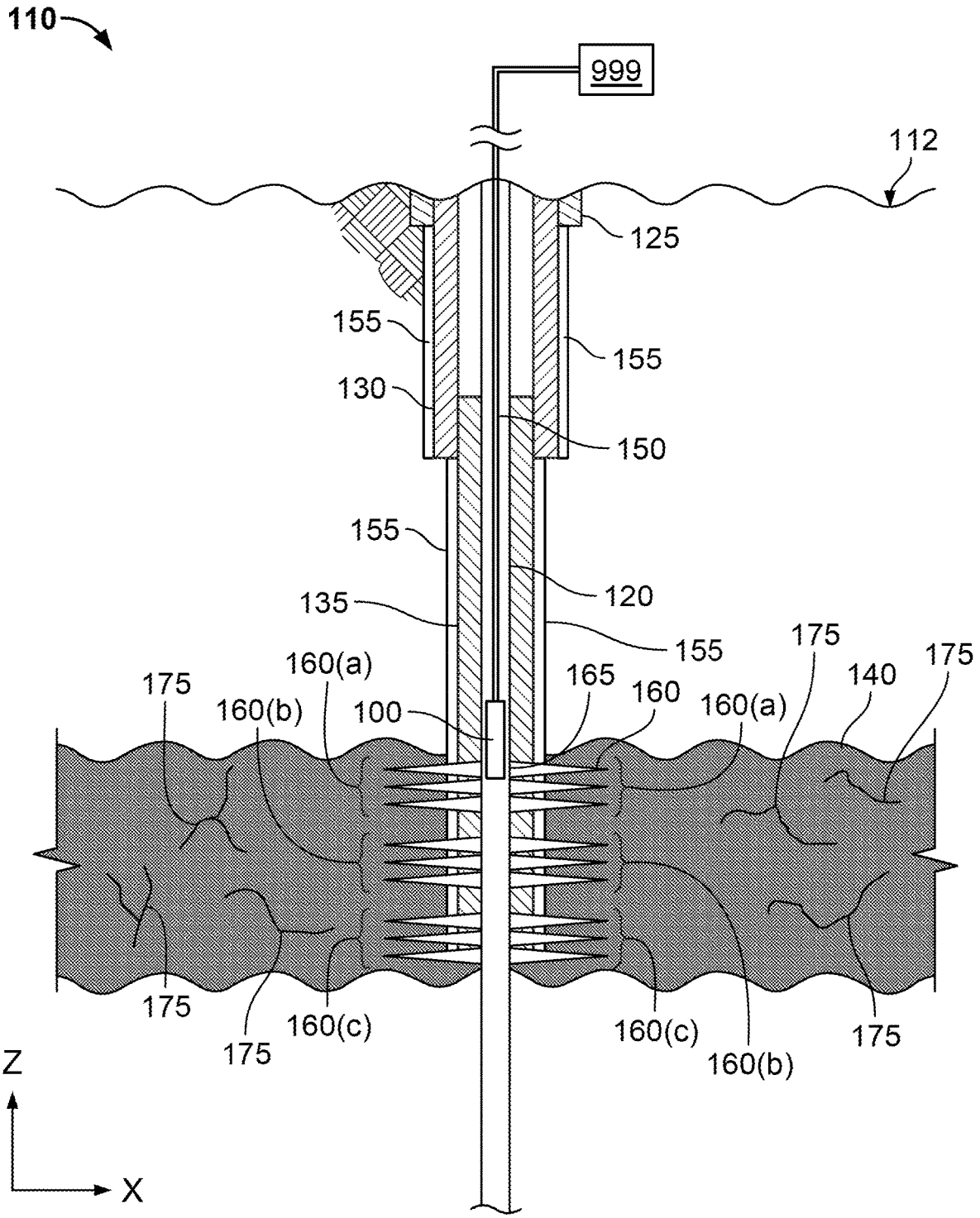
FIG. 1 is a schematic diagram of a wellbore with a bottom hole assembly.

It is to be understood that the various exemplary implementations shown in the figures are merely illustrative representations and are not necessarily drawn to scale.

DETAILED DESCRIPTION

Perforating tools, e.g., perforating guns or abrasive jet perforating tools, are used in the oil and gas industry for creating perforation cluster in well casings and surrounding formations. Abrasive jet perforating tool includes nozzles that direct a mixture of high-pressure fluid and abrasive particles toward the target area. In operation, the nozzles are often placed in a location in the wellbore facing the target at a fixed standoff distance. Perforating guns can include shaped charges and a perforating gun body. Shaped charges are positioned at specific angles within the gun body and configured to direct high-pressure and high-velocity jets of metal particles toward the well casing and the surrounding rock formation. Abrasive jet perforating tools, with their high fluid flux combined with abrasive particles, offer the advantage of generating perforations of large diameters and free of compaction zones, compared to perforating guns. On the other hand, the perforating guns can create deeper perforations.

This disclosure describes a bottom hole assembly to form wider, deeper and/or consistent perforations. In some aspects, the bottom hole assembly to form perforations includes an abrasive jet perforating tool configured to couple to a downhole conveyance that is extendable from a terranean surface, through a wellbore, and to a subterranean formation. The abrasive jet perforating tool is configured to inject abrasive particles along a radial direction to create perforations in the subterranean formation. The bottom hole assembly also includes a hydraulically actuated subassembly attached to the abrasive jet perforating tool. The hydraulically actuated subassembly is configured to move the abrasive jet perforating tool or nozzles towards or away from the subterranean formation along the radial direction. The hydraulically actuated subassembly can also be referred as hydraulically actuated assembly in this disclosure.

Implementations of the present disclosure can provide one or more of the following technical advantages. For example, the techniques described herein can adjust nozzle standoff distances after the initial penetration is formed by a perforating tool. The standoff distance can be reduced by bringing a perforating tool and/or a jetting nozzle closer to the initial perforation cavity. In example implementations, the jetting nozzle head can be inserted inside the perforation cavity. The movement of the perforating tool and/or a jetting nozzle towards the formation can be controlled by a hydraulically actuated subassembly. In an example, the hydraulically actuated subassembly includes a telescopic cylinder that pushes the perforating tool closer to the initial perforations to form deeper and/or wider perforations. In another example, the hydraulically actuated subassembly includes a telescopic jet nozzle, which is configured to extend towards or retract away from the formations. With an adjustable standoff distance, the perforating tool can better focus the abrasive particles into the initial perforations to form a deeper and wider perforations. The deeper and wider perforations can create a weak point in the wellbore which facilitates creation of fractures in the formation at a lower pressure.

FIG. 1 is a schematic diagram of a wellbore system 110 that includes a wellbore 120 with a bottom hole assembly. Generally, FIG. 1 illustrates a portion of one implementation of the wellbore system 110 in which wellbore 120 is formed into a naturally fractured subterranean formation (or reservoir) 140 for the production of one or more hydrocarbon fluids to a terranean surface 112 (through the wellbore 120 and, if used, one or more wellbore tubular strings). Fractured subterranean formation 140 that holds the hydrocarbon fluid(s) can be present beneath several other formation rock layers. The formation 140 can include a primary porous medium of the formation rock. An irregular system of microscopic fractures and small cavities can be typically present in the primary porous rock medium. Natural fractures 175 in the formation 140 can also be present across a wide range of scale, ranging from microfractures to extensive fractures or faults of thousands of meters.

As shown, the wellbore system 110 accesses a subterranean formation 140 that provides access to hydrocarbons located in such subterranean formation 140. A drilling assembly (not shown) may be used to form the wellbore 120 extending from the terranean surface 112 and through one or more geological formations in the Earth. One or more subterranean formations, such as subterranean formation 140, are located under the terranean surface 112. As will be explained in more detail below, one or more wellbore casings, such as an intermediate casing 130 and production casing 135, may be installed in at least a portion of the wellbore 120. In example implementations, a drilling assembly used to form the wellbore 120 may be deployed on a body of water rather than the terranean surface 112. For instance, in example implementations, the terranean surface 112 may be an ocean, gulf, sea, or any other body of water under which hydrocarbon-bearing formations may be found. In short, reference to the terranean surface 112 includes both land and water surfaces and contemplates forming and developing one or more wellbore systems 110 from either or both locations.

In example implementations of the wellbore system 110, the wellbore 120 may be cased with one or more casings. As illustrated, the wellbore 120 includes a conductor casing 125, which extends from the terranean surface 112 shortly into the Earth. A portion of the wellbore 120 enclosed by the conductor casing 125 may be a large diameter borehole. Additionally, in example implementations, the wellbore 120 may be offset from vertical (for example, an inclined wellbore). Even further, in example implementations, the wellbore 120 may be a stepped wellbore, such that a portion is drilled vertically downward and then curved to a substantially horizontal wellbore portion. Additional substantially vertical and horizontal wellbore portions may be added according to, for example, the type of terranean surface 112, the depth of one or more target subterranean formations, the depth of one or more productive subterranean formations, or other criteria.

Downhole of the conductor casing 125 can be the intermediate casing 130. The intermediate casing 130 may enclose a slightly smaller borehole and protect the wellbore 120 from intrusion of, for example, freshwater aquifers located near the terranean surface 112. The wellbore 120 may than extend vertically downward. This portion of the wellbore 120 may be enclosed by the production casing 135. Other casings, not specifically shown in this figure, can be included within the wellbore system 110 without departing from the scope of this disclosure.

As shown in FIG. 1, a cement layer 155 (or cement 155) is installed in an annulus between each illustrated casing (conductor casing 125, intermediate casing 130, and production casing 135) and the adjacent geologic formation (such as subterranean formation 140). Cement 155 can be circulated downward, during the construction of the wellbore system 110, through one or more casings and back upward into the annulus between the particular casing and the adjacent geologic formation in order to, for example, bond the casing to the formation. Once solidified in the annulus, the cement 155 can provide a barrier to fluid entry into the wellbore 120 as well as maintain the casings in place.

In the schematic of FIG. 1, the wellbore 120 has been hydraulically (or otherwise) perforated to create perforations 160, each of which, for example, extending through the casing 135. Multiple perforation clusters 160*a*, 160*b* and 160*c* can be formed simultaneously or sequentially. Such perforations in the formation 140 can be accomplished by any known technique (or any technique developed therefore). Although shown as a cased wellbore, the wellbore 120 (for example, at a depth at which the perforation clusters 160*a*, 160*b* and 160*c* are formed) can be an open hole completion (thereby eliminating, in some aspects, the need for perforating through the casing 135).

A downhole conveyance 150 is deployed to convey tools and instruments downhole. The downhole conveyance 150 is extendable from a terranean surface 112, through a wellbore 120, and to a subterranean formation 140. The downhole conveyance 150 can be a wireline, e.g., a single or multi-strand wire cable. Wireline cables can incorporate conductors for electrical power and data transmission. The downhole conveyance 150 can be a coiled tubing, e.g., a continuous length of steel or composite tubing wound on a reel which can convey fluids, tools, and equipment into the wellbore 120 while providing pressure control and flexibility. The downhole conveyance 150 can also be a slickline, e.g., a single-strand wire or cable used for light-duty operations such as setting or retrieving downhole equipment, taking fluid samples, or conducting basic well interventions. The downhole conveyance 150 can also be a drilling pipe. Drilling pipes can be used in the drilling process to convey drilling fluids, transmit torque, and carry out other functions necessary for drilling operations.

The uphole end of the downhole conveyance 150 can be coupled to a top subassembly (not shown). The top subassembly can include various tools and equipment crucial for downhole operations. For example, the top subassembly can include a top drive or a blowout preventer (BOP). The top drive can be a motorized drilling system installed on the drilling rig's mast or derrick. It rotates the drill string, providing the necessary torque and rotational power to drill the well. BOP can be configured to prevent uncontrolled releases of formation fluids (blowouts) during drilling, completion, or production operations. It can include a series of valves and hydraulic mechanisms that can seal off the wellbore, effectively isolating pressure zones and mitigating blowout risks.

In the schematic of FIG. 1, a bottom hole assembly 100 is shown run into the wellbore 120 on the downhole conveyance 150 (e.g., a wireline, slickline, coiled tubing, or other conveyance). In example implementations, the bottom hole assembly 100 includes an abrasive jet perforating tool. The abrasive jet perforating tool utilizes high-pressure abrasive jets to cut through the well and penetrate into the formation. Abrasive jets can be streams of water or another suitable liquid mixed with abrasive materials (e.g., sand or ceramic particles) propelled at high velocity. This method can create larger perforation diameters compared to perforating guns. The abrasive jet perforating tool can have nozzles to direct the abrasive particles toward the target formation. As the abrasive particles propel at high velocities, they effectively cut slots in the well and penetrate the rock, forming perforations.

In example implementations, the bottom hole assembly 100 includes a perforating gun. Perforating guns deploy shaped charges that generate high-velocity, concentrated jets of explosive charges. The shaped charges are strategically positioned within the perforating gun, and upon initiation, they create perforations by penetrating the well casings and surrounding rock formations. Perforating guns can achieve greater penetration depths than the abrasive jet perforating tool. They can be valuable in hard or consolidated formations where the focused energy from the shaped charges allows for efficient perforation. The choice between an abrasive jet perforating tool and a perforating gun depends on several factors, including formation characteristics, wellbore conditions, and geometry required for perforations.

In example implementations, the bottom hole assembly 100 includes a hydraulically actuated subassembly attached to the abrasive jet perforating tool and configured to move the abrasive jet perforating tool towards or away from the subterranean formation 140 along the radial direction, as described with further details in FIGS. 3A through 5. In example implementations, the hydraulically actuated subassembly includes a telescopic jet nozzle which moves its position towards or away from the subterranean formation 140 along the radial direction, as described with further details in FIG. 5. The hydraulically actuated subassembly can be utilized to modify the standoff distance between the jetting tool nozzles and the target, facilitating creation of the deeper and/or wider perforations 160, as described with further details in FIGS. 2A through 5.

The geometry of perforations can play an important role in well productivity, reservoir management, and overall operational success. For example, the size and diameter of perforations directly impact the flow of fluids between the reservoir and the wellbore, and pressure distribution during hydraulic fracturing. Larger perforations allow for increased flow rates and faster hydraulic fracture initiation and propagation. The spacing between adjacent perforations determines the density of the induced fractures. In addition, perforations serve as the initial points of contact between the wellbore and the formation during hydraulic fracturing. The depth of the perforations influences the direction and extent of fracture propagation. Further, the orientation of perforations relative to natural fracture networks or bedding planes can influence well performance. In some cases, aligning perforations perpendicular to natural fractures or bedding planes can enhance reservoir connectivity and productivity. In general, consistent perforation geometry, e.g., diameter, depth, and/or space, helps prevent flow imbalances and production inefficiencies.

As shown in FIG. 1, a control system 999 can be communicably coupled (wired or wirelessly) to the bottom hole assembly 100 to operate the bottom hole assembly 100. The control system 999 can include a computer-readable medium (e.g., a non-transitory computer-readable medium) storing computer instructions executable by one or more processors. The one or more processors can execute the stored computer instructions to perform operations described in this disclosure. The control system 999 can be configured to control the fluid pressure. This includes monitoring, adjusting, and maintaining the pressure of the fluid circulating during well operations. Additionally, the control system 999 can be configured to respond to various inputs or triggers, automatically adjusting the fluid pressure as necessary to accommodate changes in operating conditions or demands. Furthermore, the control system 999 can control operations of the bottom hole assembly 100. For example, the control system 999 can control the timing of the perforating shots, adjust the position (e.g., target depth) and orientation of the perforating tool, and/or initiate explosive charges.

Although not shown in FIG. 1, it is understood that the wellbore 120 can include a horizontal portion, e.g., a horizontal well parallel to the terranean surface 112. In general, a horizontal well is drilled horizontally through a reservoir formation. The horizontal well can intersect more reservoir rock compared to a vertical well. This allows for increased contact with the hydrocarbon-bearing formation, which can enhance production rates of oil or gas.

Figure 2B:
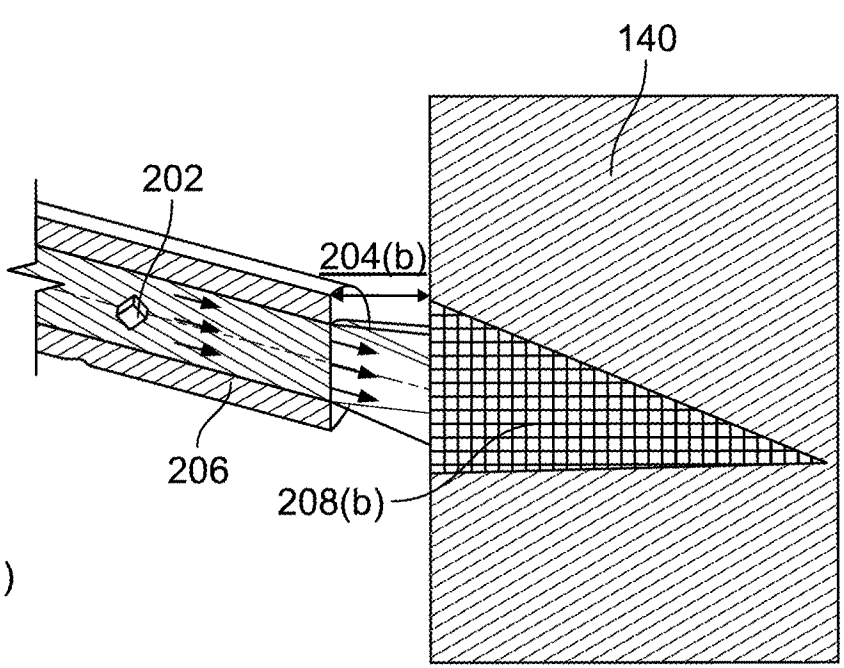
FIGS. 2A through 2B illustrate an example path of abrasive particles ejected from an abrasive jet perforating tool.
Figure 2A:
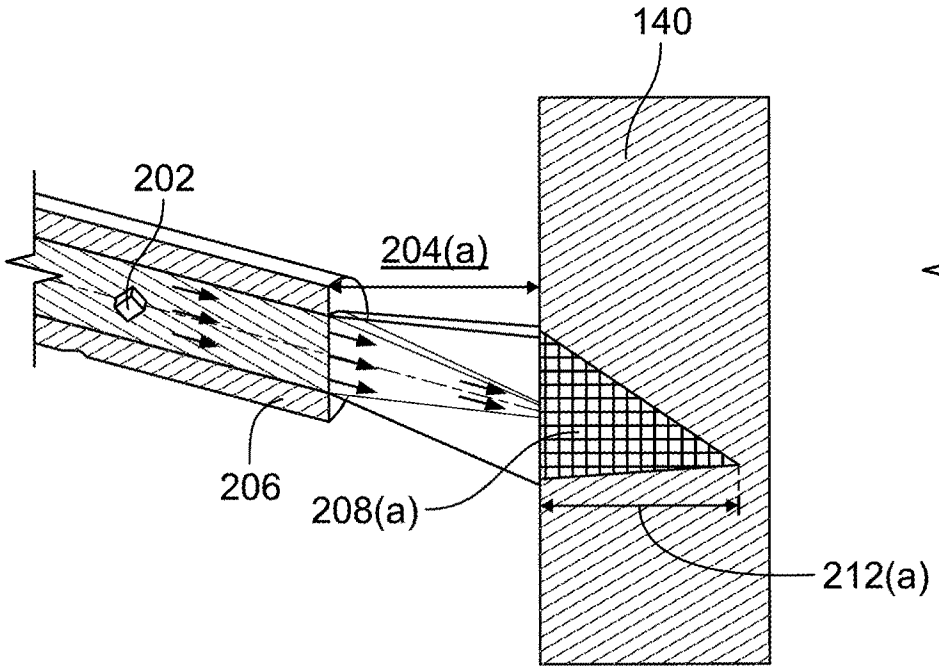

FIGS. 2A-2B illustrates an example path of abrasive particles ejected from an abrasive jet perforating tool. As noted above, compared to perforating gun, the abrasive jet perforating tool have limited penetration capability, particularly in hard formations. In operation, the nozzles 206 are often placed in a location in the wellbore 120 facing the target, e.g., well casings or target formations 140, at a standoff distance 204(*a*). The standoff distance 204(*a*) can be the distance between the nozzle head and the surface of the well casing or the target formation 140. It is the radial distance from the point where the abrasive particles 202 are jetted from the nozzles 206 to the target area or the surrounding formation 140. The standoff distance can influence the effectiveness and geometry of the perforations 208(*a*) created.

For example, it can impact factors such as the size (e.g., width or diameter) and shape of the perforations, the extent of penetration into the reservoir formation 140, and eventually the overall efficiency of fluid flow from the reservoir formation 140 into the wellbore 120. The jetting operation can persist until the perforation reaches its maximum penetration depth 212(*a*) at the standoff distance 204(*a*). The abrasive particles exiting the nozzle undergoes acceleration near the nozzle head achieving optimal velocity and scattering at certain distance from the nozzle orifice. Subsequently, as their kinetic energy is reduced, there is a deceleration phase occurring after a specific standoff distance. Because of decreased kinetic energy, the perforations 208(*a*) can be narrower at the deeper sections of the perforations, e.g., near the tip of the perforations, and depth of the penetration is limited, as illustrated in FIG. 2A.

To address this issue, the techniques disclosed herein utilized hydraulically actuated subassembly (not shown) to bring the jet nozzle 206 closer to the formation 140, as described below with further details in FIGS. 3A through 5. This adjustment can be deployed after an initial perforation 208(*a*) is created at the initial standoff distance 204(*a*). That initial larger standoff distance allows to take advantage from natural dispersion in the jet, facilitating abrasive particles to strike the target over a wider angle and area that results in wider initial perforation 208(*a*). As the jet nozzle 206 gets closer to the target formation 140, the second standoff distance 204(*b*) is shorter than the initial standoff distance 204(*a*). Shorter standoff distances reduce the distance the abrasive particles travel before impacting the target surface. This time, that results in loss of kinetic energy during particle travel. The abrasive energy can thus be more focused into the target surface, e.g., the tip of initial perforations 208(*a*). Such control of intensified erosion energy concentration via adjusting the standoff distance-enhances the erosive action of the abrasive particles, resulting in deeper and/or wider more effective perforations 208(*b*). It is understood that the perforations 208(*a*) and 208(*b*) can be implemented as perforations 160 in FIG. 1.

Figures 3A, 3B, 3C:
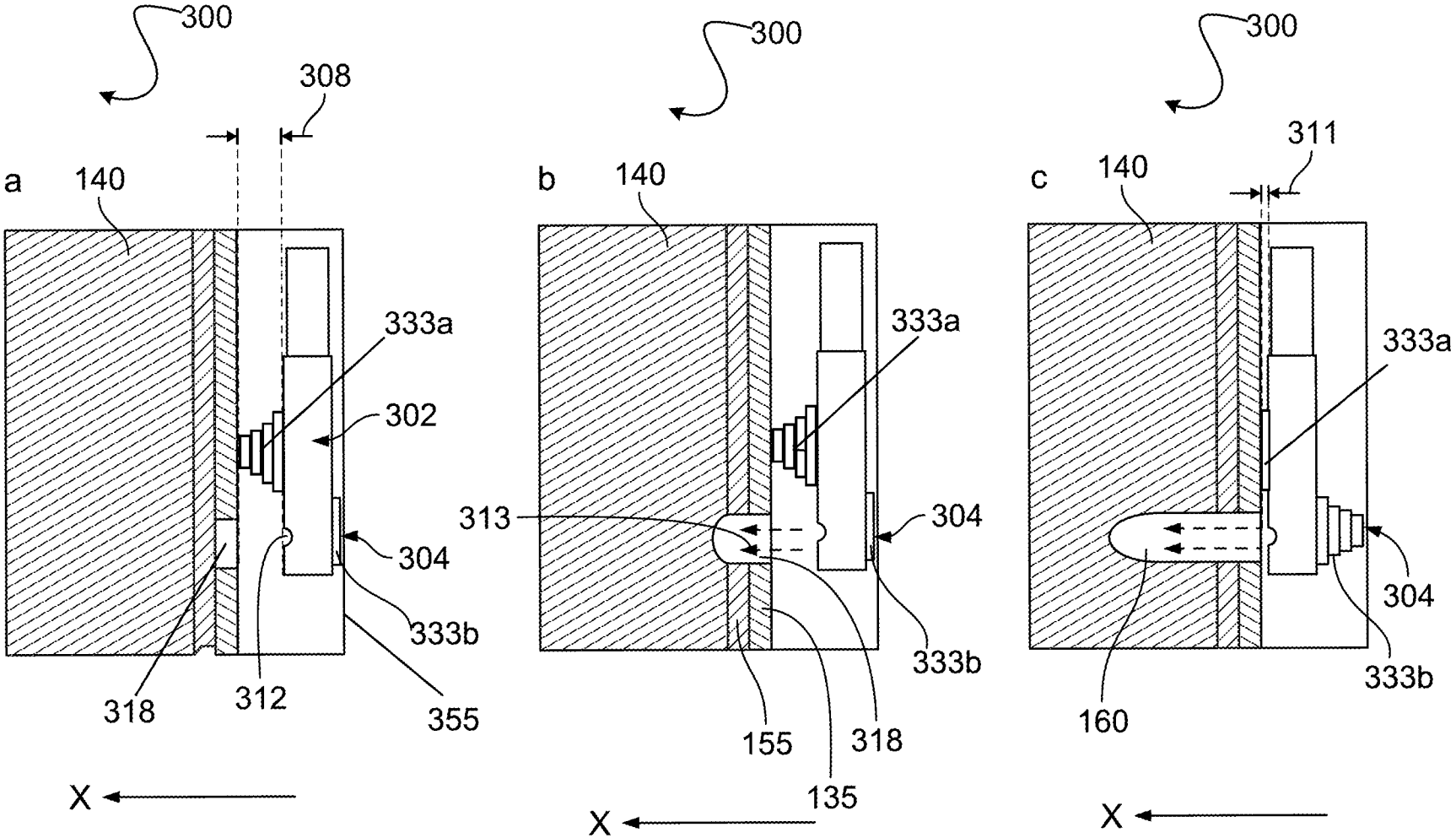
FIGS. 3A through 3C illustrate an example bottom hole assembly with a hydraulically actuated subassembly.

FIGS. 3A-3C illustrates an example bottom hole assembly (BHA) 300. The bottom hole assembly 300 includes an abrasive jet perforating tool 302 and hydraulically actuated subassembly 304. The abrasive jet perforating tool 302 is configured to couple to the downhole conveyance 150 (see FIG. 1). The downhole conveyance 150 is extendable from a terranean surface 112, through a wellbore 120, and to a subterranean formation 140. The abrasive jet perforating tool 302 is configured to inject abrasive particles along a radial direction through an opening 312. The abrasive particles are deployed to create perforations 160 in the subterranean formation 140. The radial direction can be the X direction in FIG. 3A.

In example implementations, the hydraulically actuated subassembly 304 includes two telescopic cylinders 333*a*, 333*b*. The two telescopic cylinders 333*a*, 333*b* can have identical structure or configuration and be collectively or individually referred as the telescopic cylinder 333 in this disclosure. Each telescopic cylinder 333 can have multiple cylindrical stages, to allow for compact shape when retracted so that the BHA can be fit and moved inside the wellbore. The stages can be made of high-strength steel. These stages are nested within each other in the folded or retracted state, as illustrated in FIGS. 3A through 3C. Each stage can have its own piston, and these pistons can be connected to a common rod. The pistons and rod can move within their respective stages. In the unfolded or extended state, as illustrated in FIG. 3C, the telescopic cylinder 333 of the hydraulically actuated subassembly 304 is at its maximum length. The individual stages extend, with each smaller stage moving out from the larger stage. The telescopic cylinder 333 can have two ends: a base end and a rod end. The base end can be one of the two ends associated with the larger diameter section of the telescopic cylinder 333. The rod end of a cylinder can be the other end of the cylinder where the piston rod extends out of the cylinder.

In example implementations, the hydraulically actuated subassembly 304 is configured to radially move the abrasive jet perforating tool 302 towards the subterranean formation 140 in response to a first fluid pressure. Additionally, the hydraulically actuated subassembly 304 can be configured to retract the abrasive jet perforating tool 302 away from the subterranean formation 140 in response to a second fluid pressure. In example implementations, the first fluid pressure is higher than the second fluid pressure. In example implementations, the hydraulically actuated subassembly 304 is functionally coupled to a directional control valve. The directional control valve can be configured to direct the hydraulic fluid to the base end or the rod end of the cylinder under different fluid pressures. In example implementations, the directional control valve directs the hydraulic fluid to the base end of the telescopic cylinder 333*b* under a lower fluid pressure and to the rod end of the telescopic cylinder 333*b* under a higher fluid pressure. In contrast, the directional control valve can direct the hydraulic fluid to the base end of the telescopic cylinder 333*a* under the higher fluid pressure and to the rod end of the telescopic cylinder 333*a* under the lower fluid pressure.

During retraction of the telescopic cylinder 333*b,* the lower fluid pressure can control the directional control valve to direct the hydraulic fluid to the base end of the telescopic cylinder 333*b*. The hydraulic pressure can cause the pistons to retract into their respective stages. To extend the telescopic cylinder 333*b,* the higher fluid pressure can control the directional control valve to direct hydraulic fluid to the rod end of the cylinder. The pressure can cause the pistons to extend, pushing each stage outward along the radial direction, e.g., the X direction. Therefore, the telescopic cylinder 333*b* can sequentially extend or retract along the radial direction. The radial direction can be the X direction as shown in FIG. 3A. The telescopic cylinder 333*a* can operate in the similar manner but with opposite movement directions. In example implementations, when the telescopic cylinder 333*b* retracts, the telescopic cylinder 333*a* extends. When the telescopic cylinder 333*b* extends, the telescopic cylinder 333*a* retracts.

In example implementations, the telescopic cylinder 333 of the hydraulically actuated subassembly 304 includes a spring attached to at least one of the stages and configured to retract the stages. In example implementations, the strings are attached to the outermost stage (the largest diameter stage). At the folded stage of the telescopic cylinder 333, the spring can be at its original shape and length. When hydraulic pressure is applied to extend the telescopic cylinder 333, the pistons can move, and the rod can extend. Simultaneously, the string attached to the outermost stage can be stretched. During retraction, hydraulic pressure can be applied to retract the telescopic cylinder 333. The spring can provide an additional mechanical force to assist in the retraction and return to its original shape and length.

The hydraulically actuated subassembly 304 is attached to the abrasive jet perforating tool 302. As illustrated in FIGS. 3A-3C, the hydraulically actuated subassembly 304 can include two telescopic cylinders 333*a,* 333*b,* which can be attached to the diametrically opposite sides of the abrasive jet perforating tool 302. When the telescopic cylinder 333*b* extends, it can press against the opposing wellbore wall 355 and move the opening 312 of the abrasive jet perforating tool 302 towards the opening 318 of the casing 135. When the telescopic cylinder 333*a* extends, it can operate in the opposite direction, pushing opening 312 of the abrasive jet perforating tool 302 away from the perforation 160, e.g., along the negative X direction, after abrasive jetting is complete.

In example implementations, when the telescopic cylinder 333*b* extends, it moves the abrasive jet perforating tool 302 towards the subterranean formation 140 along the radial direction, e.g., the positive X direction. In example implementations, when the telescopic cylinder 333*a* extends, it moves the abrasive jet perforating tool 302 away from the subterranean formation 140 along the radial direction, e.g., the negative X direction.

FIG. 3A illustrates a retracted state of the telescopic cylinder 333*b,* where the opening 312 of the abrasive jet perforating tool 302 is at a first standoff distance 308. As noted above in FIGS. 2A and 2B, the standoff distance is the distance between the openings 312 and the target. The target can be the casings 135, the cement 155 or the formation 140. As illustrated in FIG. 3B, at the first standoff distance 308, the abrasive jet perforating tool 302 is operated to perform a first blasting to create initial holes 313 in the formation 140. In example implementations, the casings 316 can have pre-formed openings 318, through which the abrasive particles travel through. Thus, the abrasive jet perforating tool 302 can be utilized to create the initial holes 313 on the cement 155 and formations 140. In example implementations, initial holes 313 are created through the casings 135, cement 155 and formation 140. As illustrated in FIG. 3B, as the first standoff distance 308 is greater when the hydraulically actuated subassembly 304 is in its retracted state, the initial holes 313 can be made wider benefitting from abrasives hitting the target surfaces at larger angles due to natural dispersion in the jet.

After the initial holes 313 are formed, the telescopic cylinder 333*b* is activated or extended under a first fluid pressure to move the abrasive jet perforating tool 302, e.g., the opening 312 of abrasive jet perforating tool 302, towards the initial holes 313, as illustrated in FIG. 3C. Therefore, the standoff distance is decreased. This decreased standoff distance is also referred as the second standoff distance 311 in this disclosure. The abrasive jet perforating tool 302 is operated to perform a second blasting to deepen and/or widen the initial holes 313 and create perforations 160 in the subterranean formation 140. It is understood that one or more additional blasting can be performed at the second standoff distance 311 to further deepen and/or widen the perforations 160. The penetration depth of the perforations 160 can be about one to three times greater than a radius of the wellbore 120. In example implementations, the telescopic cylinder 333*a* retracts under the first fluid pressure, while the telescopic cylinder 333*b* extends under the first fluid pressure.

After perforating process is completed, the telescopic cylinder 333*b* can retract under a second fluid pressure which allows to move the abrasive jet perforating tool 302 away from the perforations. In example implementations, the telescopic cylinder 333*a* extends under the second fluid pressure, pushing the abrasive jet perforating tool 302 away from the formation 140. In example implementations, the second fluid pressure is lower than the first fluid pressure.

Figure 4C:
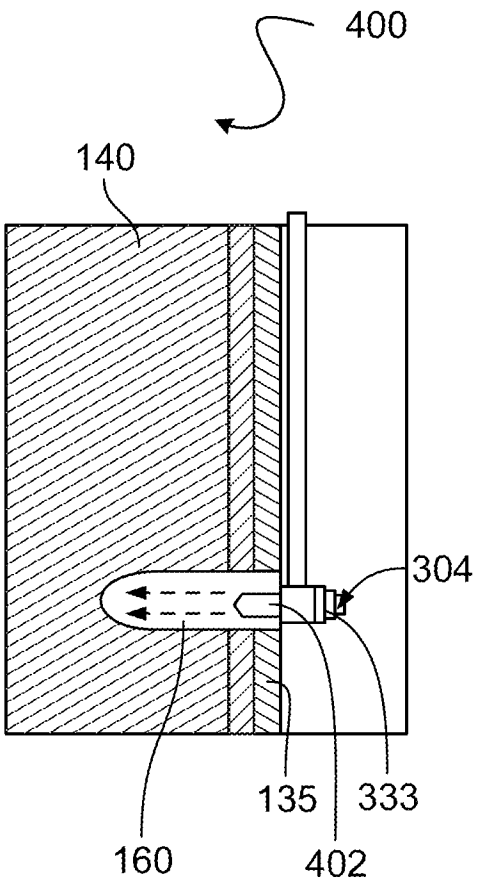
FIGS. 4A through 4C illustrate another example bottom hole assembly with a jet nozzle and a hydraulically actuated subassembly.
Figure 4B:
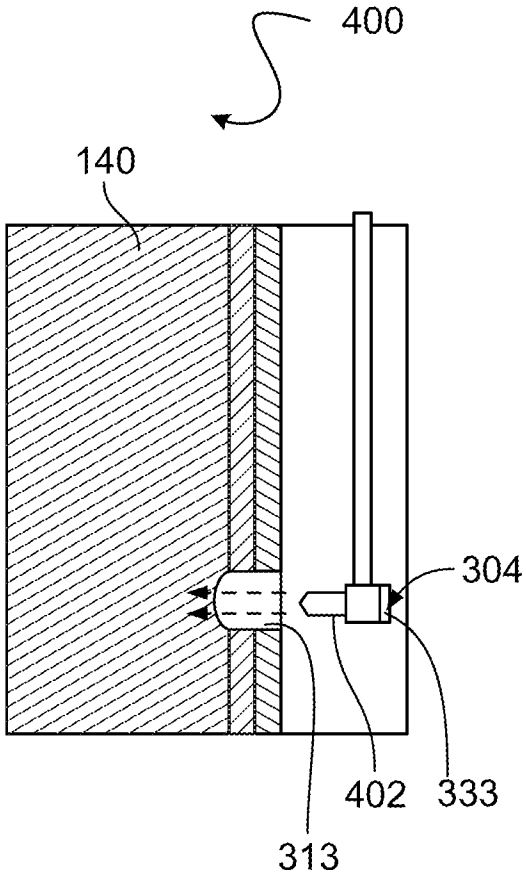
Figure 4A:
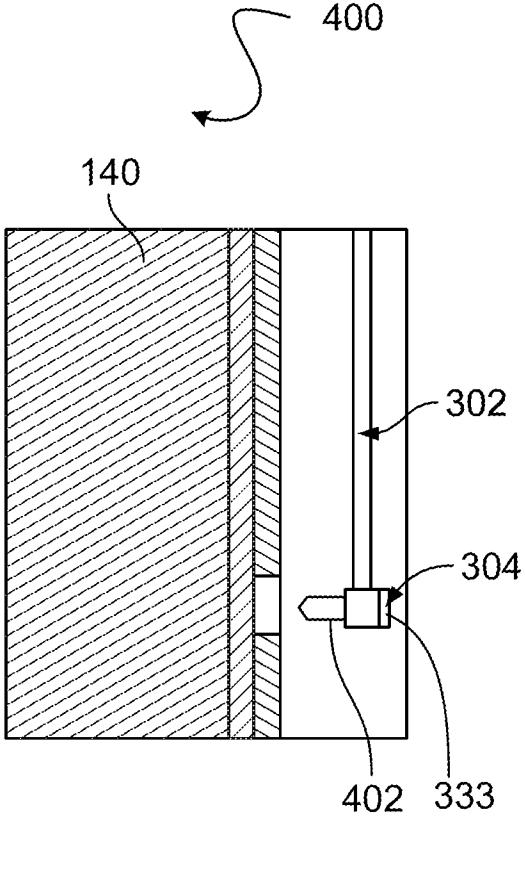

FIGS. 4A-4C illustrates an example bottom hole assembly 400 with a jet nozzle 402 and a hydraulically actuated subassembly 304. In example implementations, the abrasive jet perforating tool 302 includes a jet nozzle 402 configured to, during a blasting operation, direct the abrasive particles out of the abrasive jet perforating tool 302 towards the subterranean formation 140. Compared to the opening 312 (see FIG. 3A), the jet nozzle 402 extends closer to the subterranean formation 140 and thus further decrease the standoff distance to the formation 140. Decreased standoff distance aids in forming a deeper perforation into the target formation 140. The hydraulically actuated subassembly 304 can include a telescopic cylinder 333. The telescopic cylinder 333 can be attached to the jet nozzle 402 and configured to move the jet nozzle 402 towards or away from the subterranean formation 140, employing methods similar to or same as the telescopic cylinder 333*b* as described in FIGS. 3A-3C. Although not shown, it is understood that another telescopic cylinder can be included in the hydraulically actuated subassembly 304 to facilitate the movement of the jet nozzle 402 towards or away from the formation 140, employing methods similar to or same as the telescopic cylinder 333*a* as described in FIGS. 3A through 3C.

When the jet nozzle 402 is moved towards the formation as illustrated in FIG. 4C, the jet nozzle 402 can be inserted into the perforations 160. This action effectively reduces the standoff distance. At a shorter standoff distance, the abrasive jet perforating tool 302 can focus the abrasive energy more into the inner surfaces of the initial perforations, e.g., initial holes 313, to form deeper and larger perforations 160. This configuration also reduces the likelihood of abrasive particles being ejected onto casings 135, thus decreasing the damage to the casings 135. Reducing casing damage in oil and gas well operations can be important for maintaining well integrity and enhancing the quality of the cement bond between the casing 135 and the wellbore wall.

Figure 5:
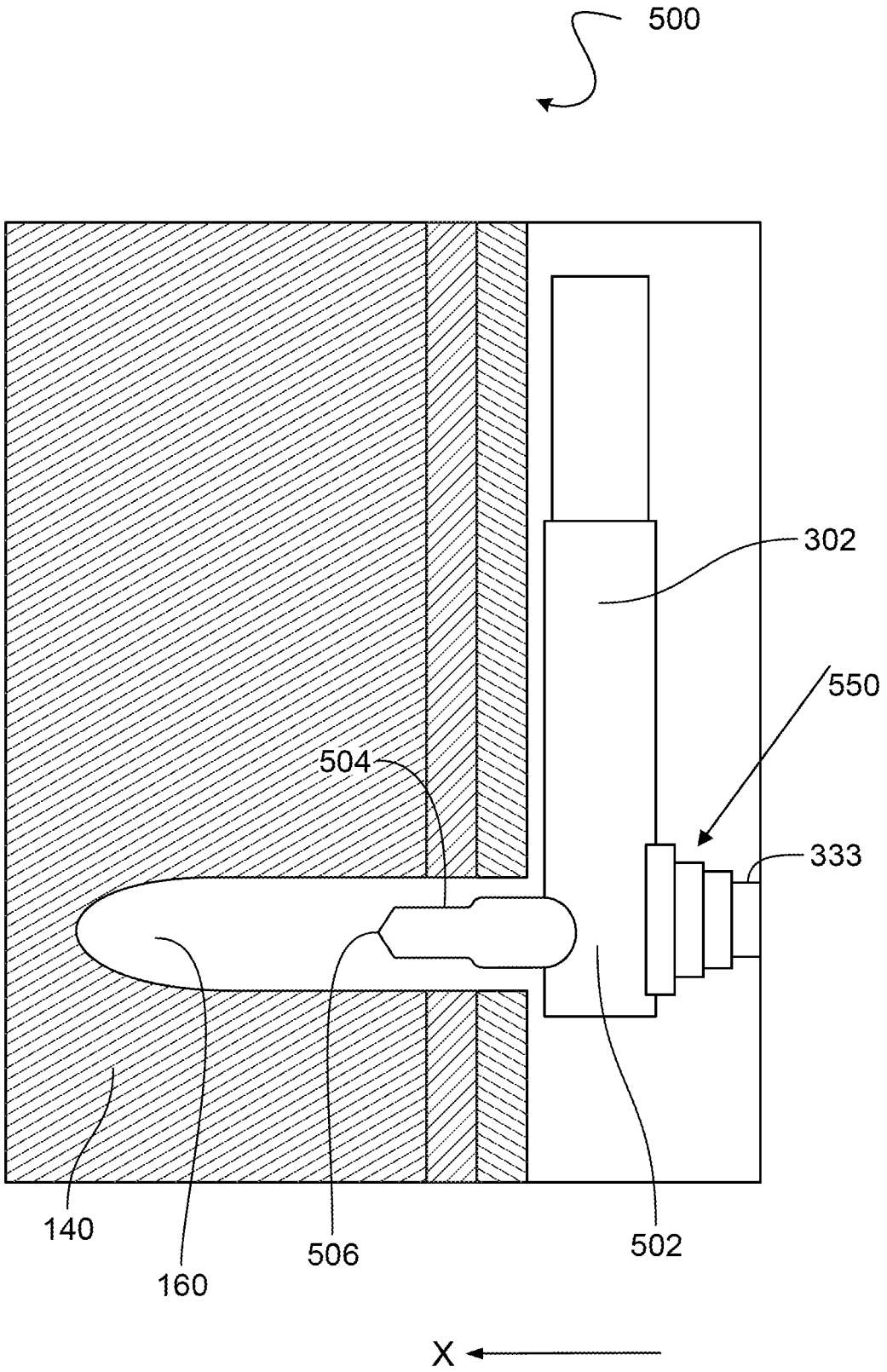
FIG. 5 illustrates another example bottom hole assembly with a hydraulically actuated subassembly.

In example implementations, the jet nozzle is a telescopic jet nozzle 504 configured to move radially towards or away from the subterranean formation 140. FIG. 5 illustrates another example bottom hole assembly 500 with a hydraulically actuated subassembly 550, where the hydraulically actuated subassembly 550 includes a telescopic cylinder 333 and a telescopic jet nozzle 504. Like the telescopic cylinder 333, the telescopic jet nozzle 504 can include multiple cylindrical stages with varying diameters. The stages can be made of high-strength steel. In its folded or retracted state, these stages can be nested within each other and the telescopic jet nozzle 504 can be positioned inside the housing 502 of the abrasive jet perforating tool 302. In its unfolded or extended state, as illustrated in FIG. 5, the telescopic jet nozzle 504 can be at its maximum length. The individual stages can extend out of the housing 502, with each smaller stage moving out from the larger stage. The nozzle opening 506 of the telescopic jet nozzle 504 can be at the end of the stage with the smallest diameter such that it extends closest to the formation 140. Although not shown, it is understood that another telescopic cylinder can be included in the hydraulically actuated subassembly 550 to facilitate the movement of the abrasive jet perforating tool 302 towards or away from the formation 140, employing methods similar to or same as the telescopic cylinder 333*a* as described in FIGS. 3A through 3C.

In example implementations, the movement of the telescopic jet nozzle 504 can be configured to be hydraulically controlled, employing methods similar to or identical to those described in FIGS. 3A through 3C. In example implementations, the movement of the telescopic jet nozzle 504 can be independently controlled, separate from the movement of the telescopic cylinder 333. For example, the telescopic cylinder 333 extends and retracts under a first and second fluid pressure respectively, while the telescopic jet nozzle 504 extends and retracts under a third and fourth fluid pressure respectively. Different fluid pressures can be regulated by the control system 999 through one or more control valves, e.g., pressure-sensitive control valves. These control valves can include sensing mechanisms that detect alterations in pressure, enabling them to adjust their positions or operation modes accordingly. In one implementation, the telescopic jet nozzle 504 can operate with the telescopic cylinder 333 in a sequential manner. For example, the telescopic cylinder 333 can be firstly activated to move the abrasive jet perforating tool 302 closer to the formation 140. The telescopic jet nozzle 504 can be subsequently activated to extend into the perforations 160, as illustrated in FIG. 5. In example implementations, the telescopic jet nozzle 504 is activated to extend towards the formation 140, while the telescopic cylinder 333 remains in its retracted state.

In example implementations, the movement of the telescopic jet nozzle 504 can be hydraulically controlled together with the movement of the telescopic cylinder 333. For example, the telescopic cylinder 333 and the telescopic jet nozzle 504 extend simultaneously under a first fluid pressure, and they retract simultaneously under a second fluid pressure. In example implementations, the hydraulically actuated subassembly 304 includes just one component, either the telescopic jet nozzle 504 or the telescopic cylinder 333. In an example with the telescopic jet nozzle 504, the main body of the abrasive jet perforating tool 302 remains stationary, with only the telescopic jet nozzle 504 configured to extend towards or retract away from the target formation 140.

Figure 6:
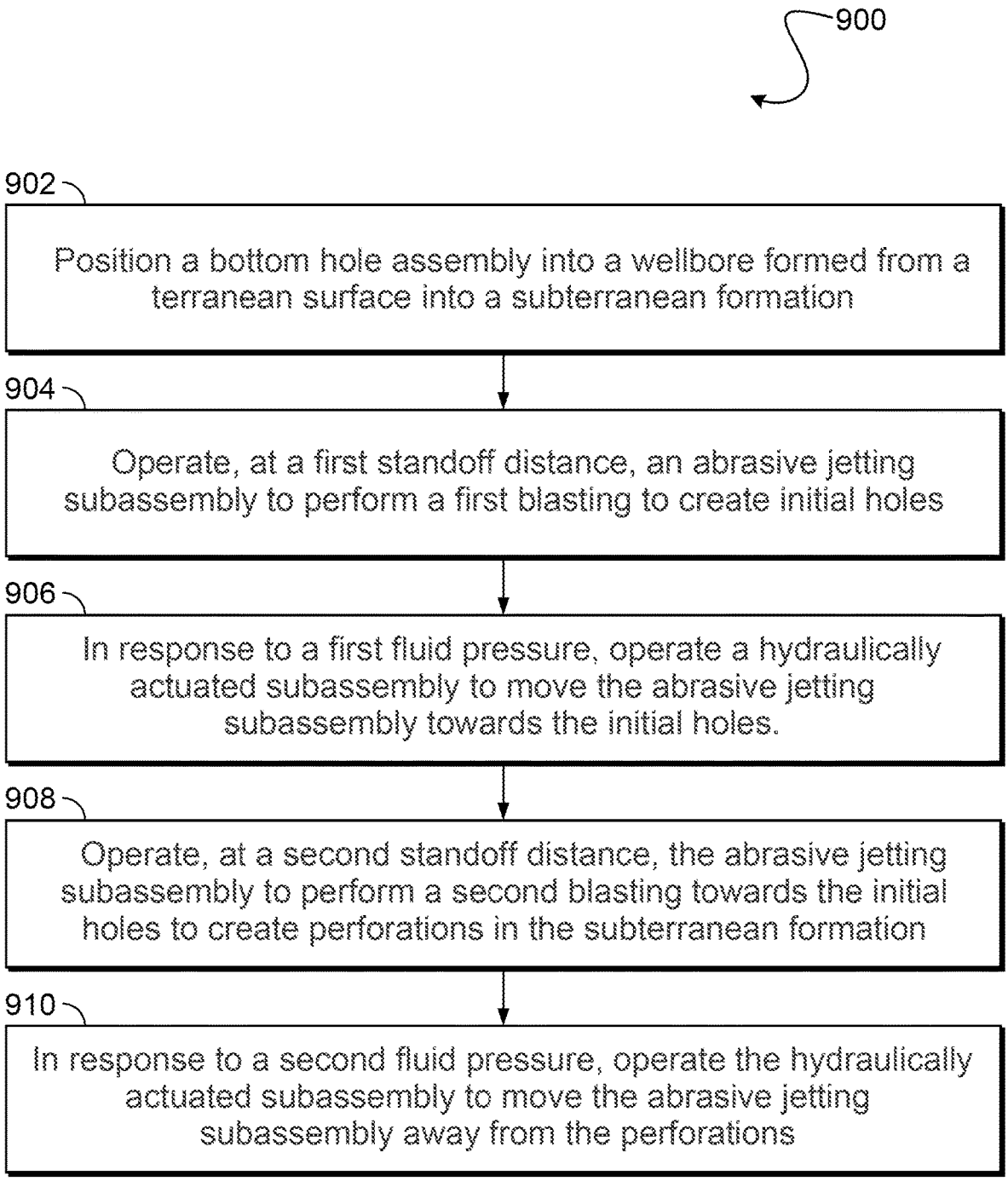
FIG. 6 illustrates a flow chart of an example process for creating perforations.

FIG. 6 illustrates a flow chart of an example process 900 for creating perforations with adjusted standoff distance. At step 902, the bottom hole assembly is positioned into a wellbore 120 formed from a terranean surface 112 into a subterranean formation 140. The bottom hole assembly includes an abrasive jet perforating tool 302 and a hydraulically actuated subassembly that is attached to the abrasive jet perforating tool 302. The hydraulically actuated subassembly can include one or more telescopic cylinder 333, each having a plurality of stages configured to sequentially extend or retract along the direction, as described above. The hydraulically actuated subassembly can be, e.g., any one of the hydraulically actuated subassembly 304 of FIGS. 3A through 4C, or the hydraulically actuated subassembly 550 of FIG. 5. The bottom hole assembly can be, e.g., the bottom hole assembly 100 of FIG. 1, the bottom hole assembly 300 of FIGS. 3A through 3C, the bottom hole assembly 400 of FIGS. 4A through 4C, or the bottom hole assembly 500 of FIG. 5.

At step 904, at a first standoff distance, the abrasive jet perforating tool 302 is operated to perform a first blasting to create initial holes 313 in the formation and/or cement. The blasting can involve jetting explosive materials or abrasive particles towards a target to break the target and form holes. Wider holes can be created at this step due to natural dispersion of the jet, allowing abrasive particles to strike the target surface over a wider angle and area that results in wider initial holes 313 (see FIGS. 3B and 4B) or wider initial perforations 208(*a*) (see FIG. 2A).

At step 906, in response to a first fluid pressure, the hydraulically actuated subassembly is extended to move the abrasive jet perforating tool 302 towards the initial holes 313. Thus, the standoff distance is decreased. The hydraulically actuated subassembly can be, e.g., any one of the hydraulically actuated subassembly 304 of FIGS. 3A through 4C, or the hydraulically actuated subassembly 550 of FIG. 5.

At step 908, at a second standoff distance 311, e.g., the decreased standoff distance, the abrasive jet perforating tool 302 is operated to perform a second blasting towards the initial holes 313 to create perforations in the subterranean formation 140. The perforations can be wider and deeper than the initial holes 313. In example implementations, one or more additional blasting can be performed to further enlarge the perforations. The perforations can be, e.g., perforations 160 of FIGS. 1, 3C, 4C and 5, or perforation 208(*b*) in FIG. 2B.

At step 910, in response to a second fluid pressure, the hydraulically actuated subassembly 304, 550 is retracted to move the abrasive jet perforating tool 302 away from the perforations.

In example implementations, the hydraulically actuated subassembly 550 includes a telescopic jet nozzle 504 configured to direct the abrasive particles out of the abrasive jet perforating tool 302 towards the subterranean formation 140. Under a third fluid pressure, the telescopic jet nozzle 504 can be extended towards the initial holes 313 in the subterranean formation 140. Under a fourth fluid pressure, the telescopic jet nozzle 504 can be retracted away from the initial holes 313 in the subterranean formation 140. As noted above, the telescopic jet nozzle 504 can be controlled in conjunction with or independently from the telescopic cylinder 333. When the telescopic jet nozzle 504 is at its extended state, the telescopic jet nozzle 504 can be inserted into one of the initial holes 313 or perforations as illustrated in FIG. 5.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous. Moreover, aspects described with reference to any figure or any implementation can be combined with aspects described with any other figure or any other implementation.

It is understood that the articles "a," "an," and "the" in this disclosure are intended to mean that there are one or more of the elements in the preceding descriptions. The terms "comprising," "including," and "having" are intended to be inclusive and mean that there may be additional elements other than the listed elements. Additionally, it should be understood that references to "one example" or "an example" of the present disclosure are not intended to be interpreted as excluding the existence of additional examples that also incorporate the recited features. For example, any element described in relation to an example herein may be combinable with any element of any other example described herein. Numbers, percentages, ratios, or other values stated herein are intended to include that value, and also other values that are "about" or "approximately" the stated value, as would be appreciated by one of ordinary skill in the art encompassed by examples of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to examples disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the examples that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

What is claimed is:

1. A bottom hole assembly to form perforations, comprising:

an abrasive jet perforating tool configured to couple to a downhole conveyance that is extendable from a terranean surface, through a wellbore, and to a subterranean formation, the abrasive jet perforating tool comprising one or more jet nozzles configured to inject abrasive particles along a radial direction to create perforations in the subterranean formation; and a hydraulically actuated subassembly attached to the abrasive jet perforating tool and configured to move the abrasive jet perforating tool towards and retract the abrasive jet perforating tool away from the subterranean formation along the radial direction;

wherein the hydraulically actuated subassembly comprises one or more cylinders disposed on a side opposite of and facing away from the one or more jet nozzles, the one or more cylinders configured to extend to move the abrasive jet perforating tool and the one or more jet nozzles toward the subterranean formation in the radial direction, and each of the one or more cylinders are configured to retract to allow the abrasive jet perforating tool and the one or more jet nozzles to move away from the subterranean formation in the radial direction.

2. The bottom hole assembly of claim 1, wherein the one or more cylinders are one or more telescopic cylinders each having a plurality of stages configured to sequentially extend or retract along the radial direction.

3. The bottom hole assembly of claim 1, wherein the hydraulically actuated subassembly is configured to move the abrasive jet perforating tool towards the subterranean formation in response to a first fluid pressure and retract the abrasive jet perforating tool away from the subterranean formation in response to a second fluid pressure.

4. The bottom hole assembly of claim 3, wherein the first fluid pressure is higher than the second fluid pressure.

5. A bottom hole assembly to form perforations, comprising:

a top subassembly configured to couple to a downhole conveyance that is extendable from a terranean surface, through a wellbore, and to a subterranean formation;

an abrasive jet perforating tool configured to couple to the downhole conveyance and inject abrasive particles along a radial direction to create perforations in the subterranean formation;

a telescopic jet nozzle attached to the abrasive jet perforating tool and configured to direct the abrasive particles out of the abrasive jet perforating tool, the telescopic jet nozzle configured to perform a first blasting to create an initial hole in the subterranean formation, and the telescopic jet nozzle configured to move towards and away from the initial hole along the radial direction and perform a second blasting to form a perforation; and a hydraulically actuated subassembly attached to the abrasive jet perforating tool and configured to move the abrasive jet perforating tool towards and retract the abrasive jet perforating tool away from the subterranean formation along the radial direction, wherein the hydraulically actuated subassembly comprises at least one cylinder attached to the abrasive jet perforating tool and disposed on a side opposite of and facing away from the telescopic jet nozzle, the at least one cylinder configured to extend to move the abrasive jet perforating tool and the telescopic jet nozzle towards the initial hole in the radial direction, and the at least one cylinder is configured to retract to allow the abrasive jet perforating tool and the telescopic jet nozzle to move away from the initial hole in the radial direction.

6. The bottom hole assembly of claim 5, wherein a movement of the telescopic jet nozzle is configured to be hydraulically controlled by fluid pressure.

7. The bottom hole assembly of claim 6, wherein the hydraulically actuated subassembly comprises a telescopic jet nozzle configured to move towards the subterranean formation in response to a first fluid pressure and retract away from the subterranean formation in response to a second fluid pressure.

8. The bottom hole assembly of claim 7, wherein the first fluid pressure is higher than the second fluid pressure.

9. The bottom hole assembly of claim 7, wherein the telescopic jet nozzle is configured to extend into one of the perforations in response to the first fluid pressure.

10. The bottom hole assembly of claim 7, wherein the telescopic jet nozzle comprises a plurality of stages configured to sequentially extend or retract along the radial direction.

11. A method to form perforations, comprising:

positioning a bottom hole assembly into a wellbore formed from a terranean surface into a subterranean formation, the bottom hole assembly comprising (i) an abrasive jet perforating tool, and (ii) a hydraulically actuated subassembly attached to the abrasive jet perforating tool, the hydraulically actuated subassembly comprises one or more jet nozzles and one or more cylinders disposed on a side opposite of and facing away from the one or more jet nozzles, the hydraulically actuated subassembly configured to move the abrasive jet perforating tool towards and retract the abrasive jet perforating tool away from the subterranean formation along the radial direction, wherein the hydraulically actuated subassembly comprises;

operating, at a first standoff distance, the abrasive jet perforating tool to perform a first blasting to create initial holes;

in response to a first fluid pressure, extending the one or more cylinders of the hydraulically actuated subassembly to move (i) a housing of the abrasive jet perforating tool and (ii) the one or more jet nozzles towards the initial holes;

operating, at a second standoff distance, the abrasive jet perforating tool to perform a second blasting towards the initial holes to create perforations in the subterranean formation; and in response to a second fluid pressure, retracting, by retracting the one or more cylinders, the abrasive jet perforating tool and the one or more jet nozzles away from the perforations.

12. The method of claim 11, wherein the one or more cylinders are one or more telescopic cylinders each having a plurality of stages configured to sequentially extend or retract along a radial direction.

13. The method of claim 11, wherein one or more jet nozzles are one or more telescopic jet nozzles configured to direct abrasive particles out of the abrasive jet perforating tool and move towards and away from the subterranean formation along a radial direction.

14. The method of claim 13, wherein the one or more telescopic jet nozzles comprises a plurality of stages configured to sequentially extend or retract along the radial direction.

15. The method of claim 13, comprising extending the one or more telescopic jet nozzles into one of the initial holes in the subterranean formation.

16. The method of claim 11, wherein the first fluid pressure is higher than the second fluid pressure.

17. The method of claim 11, wherein the perforations are deeper and wider than the initial holes.

18. The method of claim 11, wherein the second standoff distance is shorter than the first standoff distance.

19. A bottom hole assembly to form perforations, comprising:

an abrasive jet perforating tool configured to couple to a downhole conveyance that is extendable from a terranean surface, through a wellbore, and to a subterranean formation, the abrasive jet perforating tool configured to inject abrasive particles along a radial direction to create perforations in the subterranean formation; and a hydraulically actuated subassembly attached to the abrasive jet perforating tool and configured to move the abrasive jet perforating tool towards and retract the abrasive jet perforating tool away from the subterranean formation along the radial direction;

wherein the hydraulically actuated subassembly comprises a telescopic jet nozzle configured to move radially towards and away from the subterranean formation, and the hydraulically actuated subassembly comprises a pair of telescopic cylinders that are respectively positioned on opposite sides of the abrasive jet perforating tool along the radial direction, and the pair of telescopic cylinders are configured to respectively extend along opposite directions, and a first telescopic cylinder of the pair of telescopic cylinders is configured to move the abrasive jet perforating tool towards the subterranean formation, and a second telescopic cylinder of the pair of telescopic cylinders is configured to retract the abrasive jet perforating tool away from the subterranean formation.

* * * * *